US010227865B2

(12) United States Patent
Chiu et al.

(10) Patent No.: US 10,227,865 B2
(45) Date of Patent: Mar. 12, 2019

(54) SYSTEM AND METHOD FOR DETERMINING DRILL STRING MOTIONS USING ACCELERATION DATA

(71) Applicant: CONOCOPHILLIPS COMPANY, Houston, TX (US)

(72) Inventors: Stephen K. Chiu, Katy, TX (US); Phil D. Anno, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 281 days.

(21) Appl. No.: 15/153,073

(22) Filed: May 12, 2016

(65) Prior Publication Data

US 2016/0334306 A1 Nov. 17, 2016

Related U.S. Application Data

(60) Provisional application No. 62/161,370, filed on May 14, 2015.

(51) Int. Cl.
*E21B 47/09* (2012.01)
*E21B 44/00* (2006.01)

(52) U.S. Cl.
CPC ..... *E21B 47/09* (2013.01); *E21B 44/00* (2013.01)

(58) Field of Classification Search
CPC ..... G06K 9/0053; E21B 44/00; E21B 45/00; E21B 47/09
See application file for complete search history.

(56) References Cited

U.S. PATENT DOCUMENTS

| | | | | |
|---|---|---|---|---|
| 7,596,481 | B2 | 9/2009 | Zamora et al. | |
| 8,255,163 | B2 * | 8/2012 | Mauldin | E21B 44/00 702/6 |
| 2005/0001737 | A1 * | 1/2005 | Baron | E21B 47/12 340/854.4 |
| 2006/0225921 | A1 | 10/2006 | Mercer | |
| 2009/0229819 | A1 | 9/2009 | Repin | |
| 2013/0049981 | A1 | 2/2013 | MacPherson et al. | |
| 2013/0245950 | A1 | 9/2013 | Jain | |
| 2013/0248247 | A1 | 9/2013 | Sugiura | |
| 2016/0334306 | A1 | 11/2016 | Chiu | |

OTHER PUBLICATIONS

Brett, J.F., et al—"Bit Whirl: A Theory of PDC Bit Failure", 1990, SPE Drilling Engineering, Society of Petroleum Engineers, pp. 275-281; 7 pgs.

Jansen, J.D., "Whirl and Chaotic Motion of Stabilized Drill Collars", 1992, SPE Drilling Engineering, Jun. 1992, Society of Petroleum Engineers, pp. 107-114; 8 pgs.

International Search Report for parent case, App. No. PCT/US2016/032118, dated Aug. 19, 2016.

* cited by examiner

*Primary Examiner* — Elias Desta
(74) *Attorney, Agent, or Firm* — Conocophillips Company

(57) ABSTRACT

Systems and methods compute dysfunctions via mapping of tri-axial accelerations of drill pipe into drill-string motions. The methods remove gravitational and centripetal accelerations to yield corrected acceleration data due to the vibration only, transform the corrected acceleration data, and maps resulting transformed acceleration data into continuous drill-string positions. The maps provide 2D/3D visualization of drill-string motions to enable real-time optimization and control of well drilling operations and other scenarios where proactive detection of temporal events in automated systems may aid in avoiding failures.

18 Claims, 8 Drawing Sheets

SYSTEM AND METHOD FOR DETERMINING DRILL STRING MOTIONS USING ACCELERATION DATA

CROSS-REFERENCE TO RELATED APPLICATIONS

This application is a non-provisional application which claims benefit under 35 USC § 119(e) to U.S. Provisional Application Ser. No. 62/161,370 filed May 14, 2015, entitled "SYSTEM AND METHOD FOR DETERMINING DRILL STRING MOTIONS USING ACCELERATION DATA," which is incorporated herein in its entirety.

STATEMENT REGARDING FEDERALLY SPONSORED RESEARCH OR DEVELOPMENT

None.

FIELD OF THE INVENTION

The present disclosure relates in general to the field of hydrocarbon drilling. More particularly, but not by way of limitation, embodiments of the present invention relate to a system and method transforming acceleration data to drill-string motions related to drilling dysfunctions.

BACKGROUND OF THE INVENTION

Hydrocarbon reservoirs are developed with drilling operations using a drill bit associated with a drill string rotated from the surface or using a downhole motor, or both using a downhole motor and also rotating the string from the surface. A bottom hole assembly (BHA) at the end of the drill string may include components such as drill collars, stabilizers, drilling motors and logging tools, and measuring tools. A BHA is also capable of telemetering various drilling and geological parameters to the surface facilities.

Resistance encountered by the drill string in a wellbore during drilling causes significant wear on the drill string, especially the drill bit and the BHA. Understanding how the geometry of the wellbore affects resistance on the drill string and the BHA and managing the dynamic conditions that lead potentially to failure of downhole equipment is important for enhancing efficiency and minimizing costs for drilling wells. Various conditions referred to as drilling dysfunctions that may lead to component failure include excessive torque, shocks, bit bounce, induced vibrations, bit whirl, stick-slip, among others. These conditions must be rapidly detected so that mitigation efforts are undertaken as quickly as possible, since some dysfunctions can quickly lead to tool failures.

Tri-axial accelerometers have been widely used in the drilling industry to measure three orthogonal accelerations related to shock and vibration during drilling operations. The magnitudes of the acceleration data provide a qualitative evaluation of the extent of the drill string vibration. The acceleration data combined with other information are typically used in the industry to produce a qualitative drilling risk index.

However, the analyses of the three orthogonal accelerations typically indicate the amount of the vibration during drilling operations. It does not provide any insight how the drill string moves around the borehole. Therefore, there is a need to transform the three orthogonal accelerations into actual motions of the drill string, providing a 2D/3D visualization how the drill string deviates from the ideal drilling condition. The drill-string motions, in turn, aid to rapidly identify drilling dysfunctions and to mitigate dysfunctions during drilling operations.

BRIEF SUMMARY OF THE DISCLOSURE

The present disclosure addresses limitations in the art by providing a system and method for mapping three orthogonal accelerations into motions of the drill string, providing a 2D/3D visualization of how the drill string deviates from the ideal drilling condition. Since the drilling vibration causes the drill string to deviate from ideal, uniform circular rotations, the mapping of the non-uniform rotations of the drill string leads to a better understanding of the dynamics of drill-string dysfunctions. The present invention calls for using measured acceleration data to map the positions of drill-string motions continuously and produces various attributes to quantify the drilling dysfunctions. 2D and 3D visualizations of various dysfunction attributes describes how the vibration affects the drill-string motions. When combined with other information, it may be used to reduce drilling vibration.

The present invention enables the development of efficient and robust workflows for controlling and optimizing well drilling operations in real time. Dysfunctions are critical for proactively detecting events that may lead to equipment failures. In the particular case of real time drilling, results should aid at improving rate of penetration and minimizing well bit failures. Extensions of the present invention could be oriented to impact any automated activity that require an efficient way to determine dysfunctions in real time signals as produced by sensors, satellite and other mobile devices.

Implementations of the present invention can include one or more of the following features: the method may further identify dysfunctions for detecting equipment failure; such equipment may comprise drilling equipment; the signal data comprises acceleration data; the acceleration data may be translated from a local moving coordinate frame to a global stationary coordinate frame; the vector cross product of radial acceleration and axial accelerations can estimate the tangential acceleration; the vector cross product of tangential acceleration and axial accelerations can estimate the radial acceleration; the vector cross product of radial acceleration and tangential accelerations can estimate the axial acceleration; the signal may include: axial vibration, downhole RPM, down-hole torque, gravitational acceleration, centripetal acceleration, radial acceleration, tangential acceleration, distance from surface, surface RPM, surface torque, hole depth, and rig state; one or more said signals are obtained from one or more downhole tri-axial accelerometers; and the mapping may be provided in 3D view or a planar (2D) view.

BRIEF DESCRIPTION OF THE DRAWINGS

The foregoing and other objects, features, and advantages of the disclosure will be apparent from the following description of embodiments as illustrated in the accompanying drawings, in which reference characters refer to the same parts throughout the various views. The drawings are not necessarily to scale, emphasis instead being placed upon illustrating principles of the disclosure.

DETAILED DESCRIPTION OF THE DISCLOSURE

Figure 1:
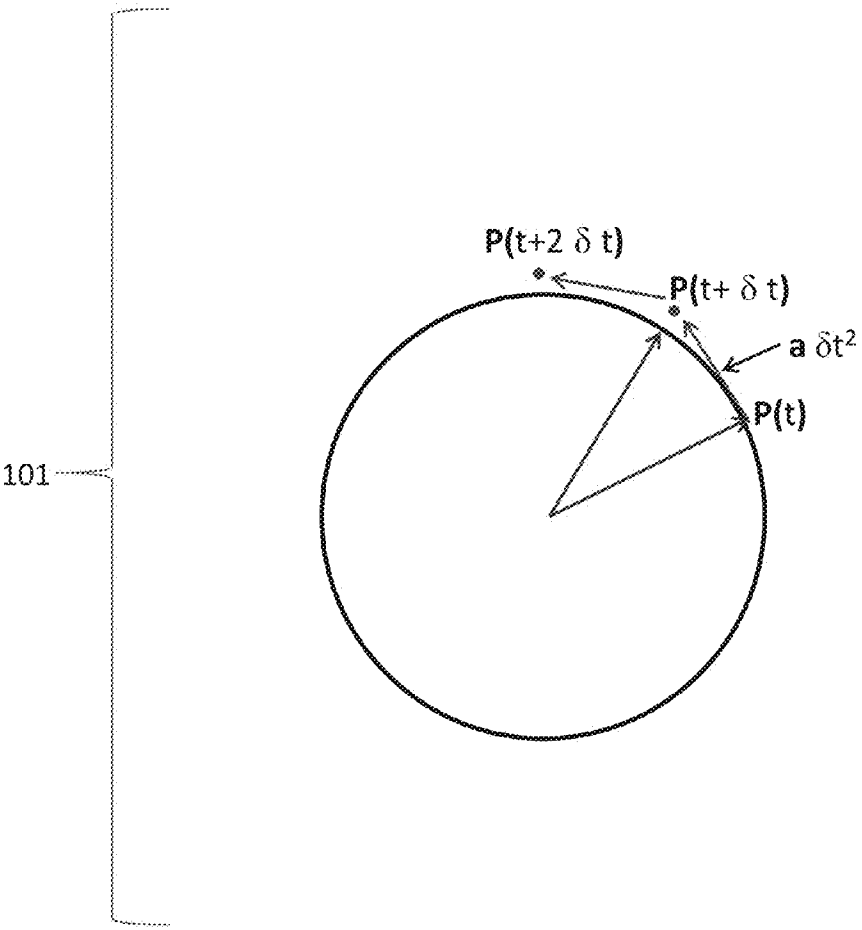
FIG. 1 depicts a vector representation of circular drill-string positions.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

While the making and using of various embodiments of the present disclosure are discussed in detail below, it should be appreciated that the present disclosure provides many applicable inventive concepts that can be embodied in a wide variety of specific contexts. The specific embodiments discussed herein are merely illustrative of specific ways to make and use the disclosure and do not limit the scope of the disclosure.

All publications and patent applications mentioned in the specification are indicative of the level of skill of those skilled in the art to which this disclosure pertains. All publications and patent applications are herein incorporated by reference to the same extent as if each individual publication or patent application was specifically and individually indicated to be incorporated by reference.

The present disclosure will now be described more fully hereinafter with reference to the accompanying figures and drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

The present disclosure is described below with reference to block diagrams and operational illustrations of methods and devices. It is understood that each block of diagrams or operational illustrations, and combinations of blocks in the diagrams or operational illustrations, can be implemented by means of analog or digital hardware and computer program instructions. These computer program instructions can be provided to a processor of a general purpose computer, special purpose computer, ASIC, or other programmable data processing apparatus, such that the instructions, which execute via the processor of the computer or other programmable data processing apparatus, implement the functions/acts specified in the block diagrams or operational block or blocks. In some alternate implementations, the functions/acts noted in the blocks can occur out of the order noted in the operational illustrations. For example, two blocks shown in succession can in fact be executed substantially concurrently or the blocks can sometimes be executed in the reverse order, depending upon the functionality/acts involved.

These computer program instructions can be provided to a processor of a general purpose computer, special purpose computer, ASIC, or other programmable data processing apparatus, such that the instructions, which execute via the processor of the computer or other programmable data processing apparatus, implement the functions/acts specified in the block diagrams or operational block or blocks.

For the purposes of this disclosure the term "server" should be understood to refer to a service point which provides processing, database, and communication facilities. By way of example, and not limitation, the term "server" can refer to a single, physical processor with associated communications and data storage and database facilities, or it can refer to a networked or clustered complex of processors and associated network and storage devices, as well as operating software and one or more database systems and application software that support the services provided by the server. Servers may vary widely in configuration or capabilities, but generally a server may include one or more central processing units and memory. A server may also include one or more mass storage devices, one or more power supplies, one or more wired or wireless network interfaces, one or more input/output interfaces, or one or more operating systems, such as Windows Server, Mac OS X, Unix, Linux, FreeBSD, or the like.

For the purposes of this disclosure a computer readable medium (or computer-readable storage medium/media) stores computer data, which data can include computer program code (or computer-executable instructions) that is executable by a computer, in machine readable form. By way of example, and not limitation, a computer readable medium may comprise computer readable storage media, for tangible or fixed storage of data, or communication media for transient interpretation of code-containing signals. Computer readable storage media, as used herein, refers to physical or tangible storage (as opposed to signals) and includes without limitation volatile and non-volatile, removable and non-removable media implemented in any method or technology for the tangible storage of information such as computer-readable instructions, data structures, program modules or other data. Computer readable storage media includes, but is not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other physical or material medium which can be used to tangibly store the desired information or data or instructions and which can be accessed by a computer or processor.

For the purposes of this disclosure a "network" should be understood to refer to a network that may couple devices so that communications may be exchanged, such as between a server and a client device or other types of devices, including between wireless devices coupled via a wireless network, for example. A network may also include mass storage, such as network attached storage (NAS), a storage area network (SAN), or other forms of computer or machine readable media, for example. A network may include the Internet, one or more local area networks (LANs), one or more wide area networks (WANs), wire-line type connections, wireless type connections, cellular or any combination thereof. Likewise, sub-networks, which may employ differing architectures or may be compliant or compatible with differing protocols, may interoperate within a larger network. Various types of devices may, for example, be made available to provide an interoperable capability for differing architectures or protocols. As one illustrative example, a router may provide a link between otherwise separate and independent LANs.

A communication link or channel may include, for example, analog telephone lines, such as a twisted wire pair, a coaxial cable, full or fractional digital lines including T1, T2, T3, or T4 type lines, Integrated Services Digital Networks (ISDNs), Digital Subscriber Lines (DSLs), wireless links including satellite links, or other communication links or channels, such as may be known to those skilled in the art. Furthermore, a computing device or other related electronic devices may be remotely coupled to a network, such as via a telephone line or link, for example.

For purposes of this disclosure, a "wireless network" should be understood to couple client devices with a network. A wireless network may employ stand-alone ad-hoc networks, mesh networks, Wireless LAN (WLAN) networks, cellular networks, or the like. A wireless network may further include a system of terminals, gateways, routers, or the like coupled by wireless radio links, or the like, which may move freely, randomly or organize themselves arbitrarily, such that network topology may change, at times even rapidly. A wireless network may further employ a plurality of network access technologies, including Long Term Evolution (LTE), WLAN, Wireless Router (WR) mesh, or 2nd, 3rd, or 4th generation (2G, 3G, or 4G) cellular technology, or the like. Network access technologies may enable wide area coverage for devices, such as client devices with varying degrees of mobility, for example.

For example, a network may enable RF or wireless type communication via one or more network access technologies, such as Global System for Mobile communication (GSM), Universal Mobile Telecommunications System (UMTS), General Packet Radio Services (GPRS), Enhanced Data GSM Environment (EDGE), 3GPP Long Term Evolution (LTE), LTE Advanced, Wideband Code Division Multiple Access (WCDMA), North American/CEPT frequencies, radio frequencies, single sideband, radiotelegraphy, radioteletype (RTTY), Bluetooth, 802.11b/g/n, or the like. A wireless network may include virtually any type of wireless communication mechanism by which signals may be communicated between devices, such as a client device or a computing device, between or within a network, or the like.

A computing device may be capable of sending or receiving signals, such as via a wired or wireless network, or may be capable of processing or storing signals, such as in memory as physical memory states, and may, therefore, operate as a server. Thus, devices capable of operating as a server may include, as examples, dedicated rack-mounted servers, desktop computers, laptop computers, set top boxes, integrated devices combining various features, such as two or more features of the foregoing devices, or the like. Servers may vary widely in configuration or capabilities, but generally a server may include one or more central processing units and memory. A server may also include one or more mass storage devices, one or more power supplies, one or more wired or wireless network interfaces, one or more input/output interfaces, or one or more operating systems, such as Windows Server, Mac OS X, Unix, Linux, FreeBSD, or the like.

For purposes of this disclosure, a client (or consumer or user) device may include a computing device capable of sending or receiving signals, such as via a wired or a wireless network. A client device may, for example, include a desktop computer or a portable device, such as a cellular telephone, a smart phone, a display pager, a radio frequency (RF) device, an infrared (IR) device an Near Field Communication (NFC) device, a Personal Digital Assistant (PDA), a handheld computer, a tablet computer, a laptop computer, a set top box, a wearable computer, an integrated device combining various features, such as features of the forgoing devices, or the like.

A client device may vary in terms of capabilities or features. Claimed subject matter is intended to cover a wide range of potential variations. For example, a mobile device may include a numeric keypad or a display of limited functionality, such as a monochrome liquid crystal display (LCD) for displaying text. In contrast, however; as another example, a web-enabled client device may include one or more physical or virtual keyboards, mass storage, one or more accelerometers, one or more gyroscopes, global positioning system (GPS) or other location-identifying type capability, or a display with a high degree of functionality, such as a touch-sensitive color 2D or 3D display, for example.

A client device may include or may execute a variety of operating systems, including a personal computer operating system, such as a Windows, iOS or Linux, or a mobile operating system, such as iOS, Android, or Windows Mobile, or the like. A client device may include or may execute a variety of possible applications, such as a client software application enabling communication with other devices, such as communicating one or more messages. The client device, mobile device, or wireless communication device, in accordance with the disclosure may be a portable or mobile telephone including smart phones, a Personal Digital Assistant (PDA), a wireless video or multimedia device, a portable computer, an embedded communication processor or similar wireless communication device. In the following description, the communication device will be referred to generally as User Equipment (UE) for illustrative purposes and it is not intended to limit the disclosure to any particular type of communication device. Certain modern handheld electronic devices (UE) comprise the necessary components to connect to a cellular network, such as a 2G, 2.5G, 3G, and/or LTE network, and the necessary components to connect to a non-cellular IP Connectivity Access Network (IP CAN) such as a wireless LAN network (e.g. IEEE 802.11a/b/g/n) or a wired LAN network (e.g. IEEE 802.3).

The principles discussed herein may be embodied in many different forms. The preferred embodiments of the present disclosure will now be described where for completeness; reference should be made at least to FIGS. 1-8.

In the present invention, the mapping of three orthogonal accelerations of drill pipe into motions of the drill string and the 2D/3D visualization of the drill-string motions enable real-time optimization and control of well drilling operations. Nevertheless, the proposed invention is not limited to the nature of drilling data and it may be applied to other problems as well where proactive detection of temporal events in automated systems may aid in avoiding failures.

In one embodiment of the present invention, the continuous drill-string position using three-orthogonal accelerations is:

$$P(x,y,z,t+dt)=P(x,y,z,t)+\iint a(x,y,z,t)dt^2 \quad (1)$$

where P(x, y, z, t) is a position vector in a global stationary coordinate frame referenced at the center of the drill string, a(x, y, z, t) is an acceleration vector in a global stationary coordinate frame referenced at the center of the drill string, t is the travel time of the drill-string motion, and dt is the time interval the drill string moves from P(x, y, z, t) to P(x, y, z, t+dt).

If dt is small and typically equal to the data sample rate in the range of 0.01 to 0.0025 sec, the $\iint a(x, y, z, t)\, dt^2$ vector can be approximated to be constant within a small time interval. Equation 1 becomes:

$$P(x,y,z,t+dt)=P(t\ x,y,z,t)+a(x,y,z,t)\delta t^2 \quad (2)$$

where δt is the time interval the drill string moves from P(x, y, z, t) to P(x, y, z, t+dt). The drill-string positions can be continuously determined using equation 2 (See FIG. 1). FIG. 1 provides a vector representation 101 of circular drill string positions.

In general, the recorded acceleration data include both the earth's gravitational and centripetal accelerations. Both accelerations should be accounted for before applying equation 2. Since the exact locations and orientations of the downhole tri-axial accelerometers at a particular instance of time are difficult to obtain because of buckling and bending of the drill string, it is extremely challenging to estimate the exact gravitational and centripetal accelerations as a position of drilling depth. This invention employs a simple, but effective method to correct both gravitational and centripetal accelerations. It approximates both corrections by a local running mean of the acceleration data. After removing the local running mean, the acceleration data yield the measurements due to the vibration only. Although this is an approximate solution, it works well in practice.

Figure 2:
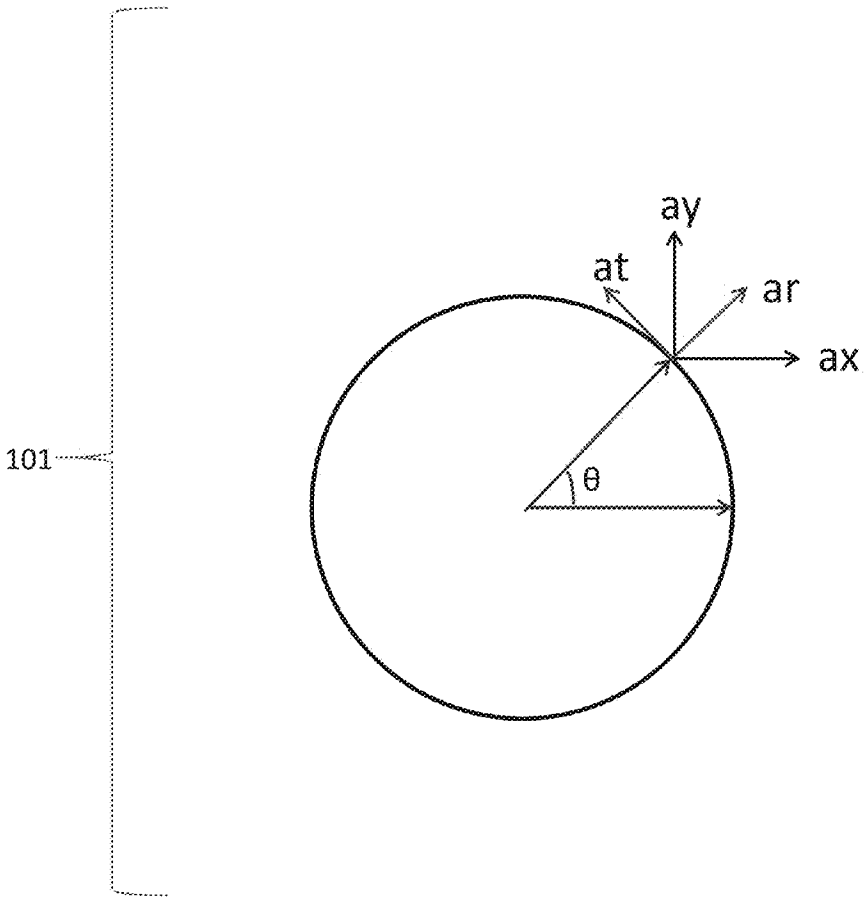
FIG. 2 depicts a transformation of acceleration data from a local moving coordinate frame to a global stationary coordinate frame.

Equation 2 also requires the acceleration data to be in a stationary coordinate frame. For standard drilling operations, the tri-axial accelerometers are mounted on the drill string. The tri-axial accelerometers are rotating with the drill string. Thus, the recorded acceleration data are in a local rotating coordinate frame. It is necessary to transform from the local rotating coordinate frame to a global stationary coordinate frame. However, since the tri-axial accelerometers are rigidly mounted on the drill string, the axial acceleration in the local rotating coordinate frame is equivalent to a stationary coordinate frame. Thus, the coordinate transformation reduces to a 2-D rotation in X-Y plane.

$$\begin{pmatrix} ax(t) \\ ay(t) \\ az(t) \end{pmatrix} = \begin{pmatrix} \cos\theta & -\sin\theta & 0 \\ \sin\theta & \cos\theta & 0 \\ 0 & 0 & 1 \end{pmatrix} \begin{pmatrix} ar(t) \\ at(t) \\ az(t) \end{pmatrix} \quad (3)$$

where ar, at and az are radial, tangential and axial accelerations in a local moving coordinate frame; ax, ay and az are the corresponding accelerations in a global stationary coordinate frame; θ is the rotational angle (See FIG. 2). FIG. 2 illustrates the transformation of acceleration data from a local moving coordinate frame to a global stationary coordinate frame.

A conventional approach to estimate the rotational angle θ uses the vector dot product between acceleration vectors ax and ar. A better and more accurate method uses downhole RPM measurements to compute θ as:

$$\theta=\omega\delta t \quad (4)$$

where ω is angular velocity of downhole RPM at a particular instance of time, and where δt is the time interval the drill string moves from P(x, y, z, t) to P(x, y, z, t+dt).

Optionally, if two acceleration components are only available, a vector cross product can be used to estimate the missing component. As an example, if tangential acceleration is not recorded, the vector cross product of radial acceleration and axial accelerations estimates the tangential acceleration.

Examples

FIGS. 3-8 illustrate two examples of the present invention by illustrating, or mapping, irregular drill string motions due to vibration.

Figure 3:
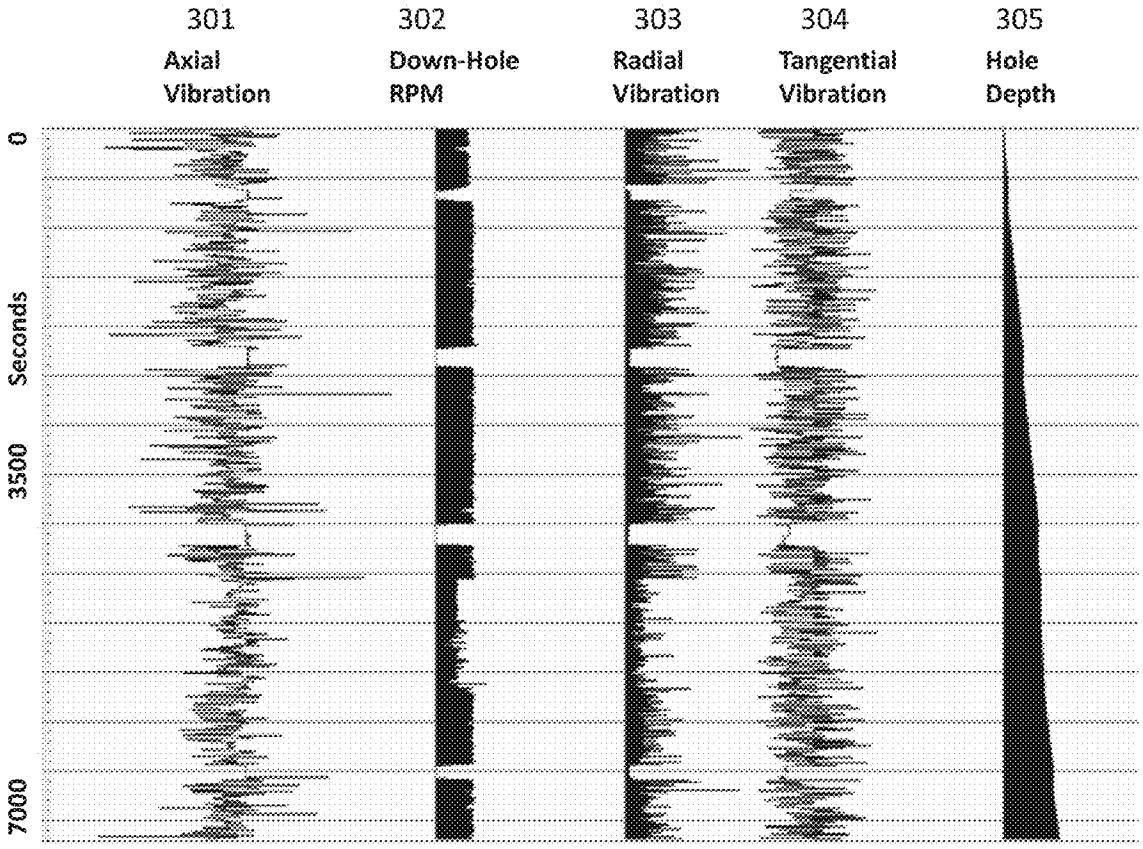
FIG. 3 depicts exemplary input data (Permian ISUB) to be used in computing the drill-string motions. Data channel 1 represents axial vibration; data channels 3 and 4 represent the polar coordinates of the radial and tangential vibrations.

The first data example (Permian ISUB) utilized the following data sources:

Sample rate=100 Hz
Axial Vibration
Down-hole RPM
Polar radial Vibration
Polar tangential Vibration
Hole Depth Turning to FIG. 3, input data is presented, including data channel 1—axial vibration 301, representing axial acceleration; data channel 2—down-hole rotations per minute (RPM) 302; data channel 3—polar radial vibration 303, representing the polar coordinates of radial acceleration; and data channel 4—labelled as polar tangential vibration 304, represent the polar coordinates of tangential acceleration. Data channel 5 presents measured hole depth 305.

The mapping of tri-axial accelerations into drill-string motions consists of 3 key steps: (1) it approximates the gravitational and centripetal accelerations by a local running mean of the acceleration data and removes the local running mean to yield the acceleration measurements due to the vibration only, (2) it transforms the corrected acceleration data from a local rotating coordinate frame to a global stationary coordinate frame using equation 3, and (3) it maps the acceleration data into continuous drill-string positions via equation 2.

Figure 4:
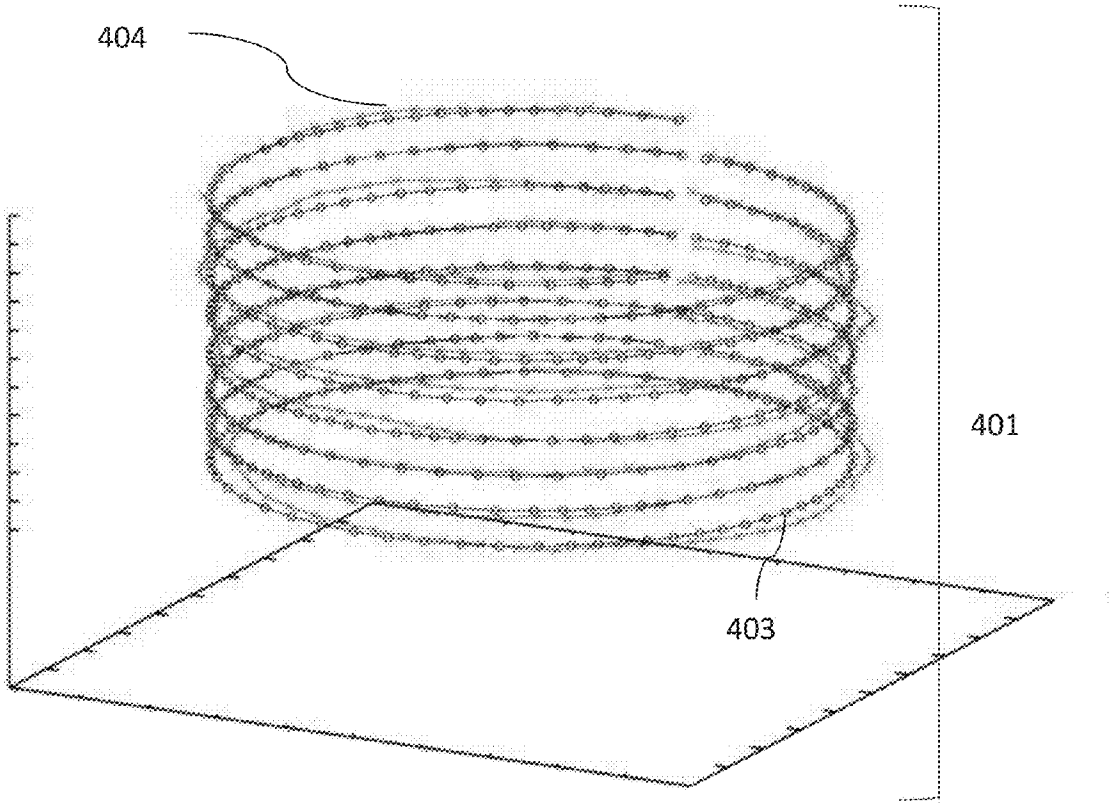
FIG. 4 depicts a 3D view of the drill-string motions of the first 500 points (Permian ISUB). Lines with circles are ideal drill-string motions, without dysfunction; lines with exes are actual drill-string motions, with drilling dysfunction.
Figure 5:
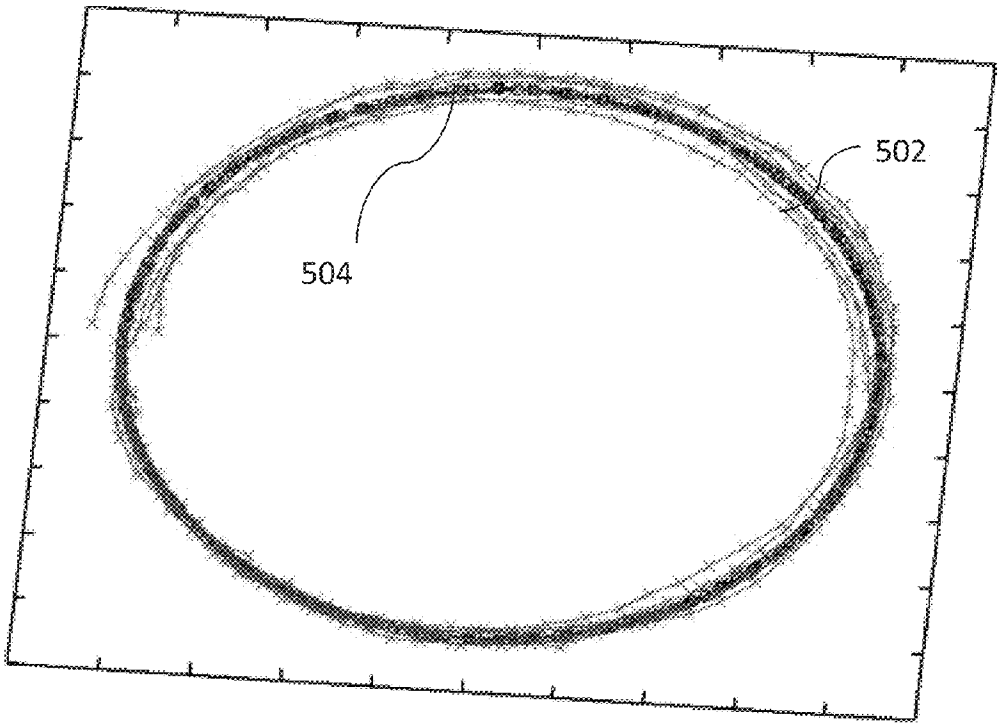
FIG. 5 depicts a map view of the drill-string motions of the first 500 points (Permian ISUB). Lines with circles are ideal drill-string motions, without dysfunction; lines with exes are actual drill-string motions, with drilling dysfunction.

FIG. 4 illustrates the first 500 points of the input data of FIG. 3 in a 3D view 401. The o-lines 403 are ideal drill-string motions without dysfunction. The x-lines 404 are actual drill-string motions observed—the input data, having drilling dysfunction. FIG. 5 illustrates a map view of the first 500 points of the input data of FIG. 3. Similar to FIG. 4, FIG. 5 depicts the o-lines 504 as representing ideal drill-string motions, without dysfunction, whereas the x-lines 502 are actual drill-string motions with drilling dysfunction.

The second data example (A4 well data) utilized the following data sources:

Sample rate=100 Hz
Axial Vibration
Radial Vibration
Down-hole RPM
Hole Depth

Figure 6:
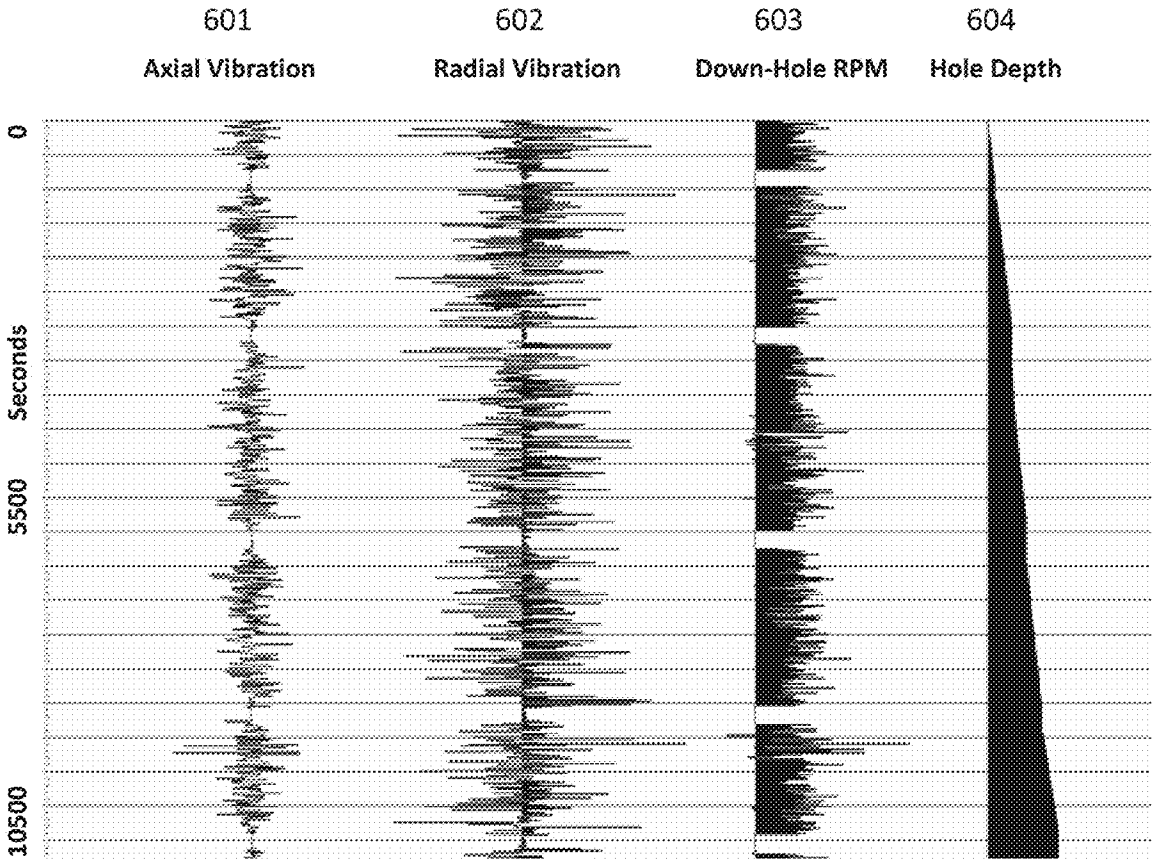
FIG. 6 depicts exemplary input data (A4 well data) to be used in computing the drill-string motions. Data channel 1 represents axial vibration and data channel 2 represents the radial vibration.

Turning to FIG. 6 input data is presented, including data channel 1—axial vibration 601, representing axial acceleration; data channel 2—radial vibration, representing the radial acceleration 602; data channel 3—down-hole RPM 603. Hole depth is also measured in data channel 5 604. The processing steps mapping bi-axial accelerations into drill-string motions are the same as the first data example, except that it includes an additional step that uses a cross product of axial and the radial accelerations to estimate tangential acceleration.

Figure 7:
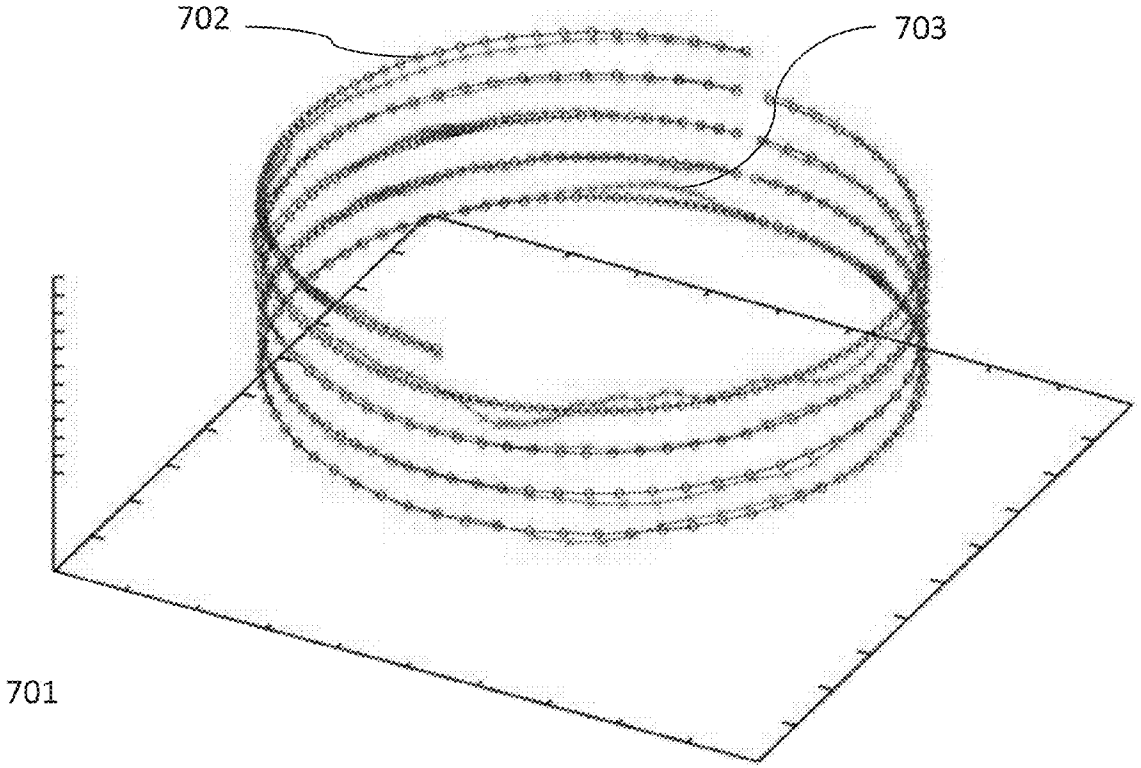
FIG. 7 depicts a 3D view of the drill-string motions of the first 500 points (A4 well data). Lines with circles are ideal drill-string motions, without dysfunction; lines with exes are actual drill-string motions, with drilling dysfunction.
Figure 8:
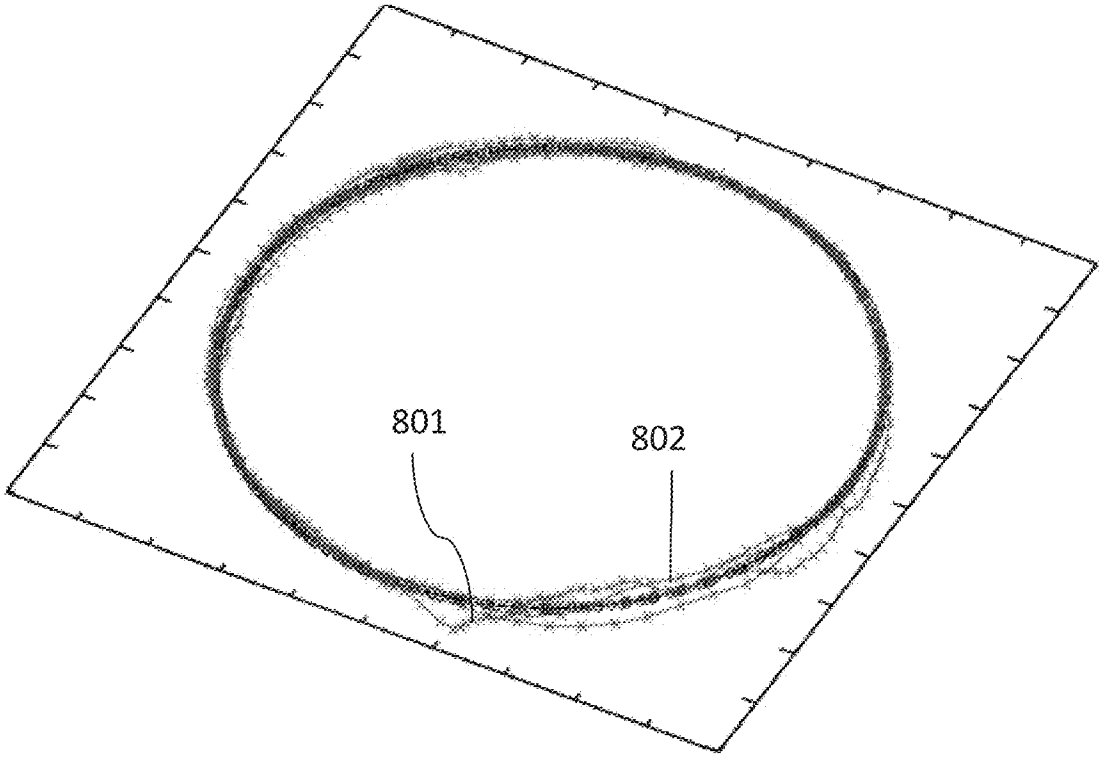
FIG. 8 depicts a map view of the drill-string motions of the first 500 points (A4 well data). Lines with circles are ideal drill-string motions, without dysfunction; lines with exes are actual drill-string motions, with drilling dysfunction.

FIG. 7 illustrates the first 500 points of the input data of FIG. 6 in a 3D view. The o-lines 702 are ideal drill-string motions without dysfunction. The x-lines 703 are actual drill-string motions observed—the input data, having drilling dysfunction. FIG. 8 illustrates a map view of the first 500 points of the input data of FIG. 6. Similar to FIG. 7, FIG. 8 depicts the o-lines 802 as representing ideal drill-string motions, without dysfunction, whereas the x-lines 801 are actual drill-string motions with drilling dysfunction.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

What is claimed is:

1. A method comprising:

(a) determining gravitational and centripetal accelerations by performing a local running mean of acceleration measurements from a drill pipe;

(b) removing the local running mean to yield corrected acceleration data due to vibration only;

(c) transforming the corrected acceleration data from a local rotating coordinate frame to a global stationary coordinate frame; and (d) mapping in real time, the acceleration data in the global stationary coordinate frame into continuous drill-string positions, wherein the acceleration data is mapped into the continuous drill-string positions using:

$$P(x,y,z,t+dt)=P(x,y,z,t)+\iint a(x,y,z,t)dt^2,$$

where P(x, y, z, t) is a position vector in a global stationary coordinate frame referenced at a center of the drill pipe; a(x, y, z, t) is an acceleration vector in the global stationary coordinate frame referenced at the center of the drill pipe; t is travel time of the drill pipe; and dt is time interval the drill pipe moves from P(x, y, z, t) to P(x, y, z, t+dt).

2. The method of claim 1, further comprising determining, via a computing device, dysfunctions for detecting equipment failure.

3. The method of claim 2, wherein the equipment comprises drilling equipment.

4. The method of claim 1, wherein a vector cross product of radial acceleration and axial acceleration estimates tangential acceleration.

5. A method comprising:

(a) determining gravitational and centripetal accelerations by performing a local running mean of acceleration measurements from a drill pipe;

(b) removing the local running mean to yield corrected acceleration data due to vibration only;

(c) transforming the corrected acceleration data from a local rotating coordinate frame to a global stationary coordinate frame; and (d) mapping in real time, the acceleration data in the global stationary coordinate frame into continuous drill-string positions, wherein the acceleration data is transformed from the local rotating coordinate frame to the global stationary coordinate frame using the equation:

$$\begin{pmatrix} ax(t) \\ ay(t) \\ az(t) \end{pmatrix} = \begin{pmatrix} \cos\theta & -\sin\theta & 0 \\ \sin\theta & \cos\theta & 0 \\ 0 & 0 & 1 \end{pmatrix} \begin{pmatrix} ar(t) \\ at(t) \\ az(t) \end{pmatrix},$$

where ar, at and az are radial, tangential and axial accelerations in the local rotating coordinate frame; ax, ay and az are radial, tangential and axial accelerations in the global stationary coordinate frame; and θ is rotational angle.

6. The method of claim 1, wherein the acceleration measurements include at least one of axial vibration, downhole rotations per minute (RPM), down-hole torque, gravitational acceleration, centripetal acceleration, radial acceleration, tangential acceleration, distance from surface, surface RPM, surface torque, hole depth, and rig state.

7. The method of claim 1, wherein the acceleration measurements are obtained from one or more downhole tri-axial accelerometers.

8. The method of claim 1, wherein the mapping further comprises a 3D view of the drill string positions.

9. The method of claim 1, wherein the mapping further comprises a planar view of the drill string positions.

10. A system, comprising:

(a) a processor; and (b) a non-transitory storage medium for tangibly storing thereon program logic for execution by the processor, the program logic comprising:

determining logic executed by the processor for determining gravitational and centripetal accelerations by performing a local running mean of acceleration measurements from a drill pipe;

removing logic executed by the processor for removing the local running mean to yield corrected acceleration data due to vibration only;

transforming logic executed by the processor for transforming the corrected acceleration data from a local rotating coordinate frame to a global stationary coordinate frame; and mapping logic executed by the processor for mapping in real time, the acceleration data in the global stationary coordinate frame into continuous drill-string positions, wherein the acceleration data is transformed from the local rotating coordinate frame to the global stationary coordinate frame using the equation:

$$\begin{pmatrix} ax(t) \\ ay(t) \\ az(t) \end{pmatrix} = \begin{pmatrix} \cos\theta & -\sin\theta & 0 \\ \sin\theta & \cos\theta & 0 \\ 0 & 0 & 1 \end{pmatrix} \begin{pmatrix} ar(t) \\ at(t) \\ az(t) \end{pmatrix}$$

where ar, at and az are radial, tangential and axial accelerations in the local rotating coordinate frame; ax, ay and az are radial, tangential and axial accelerations in the global stationary coordinate frame; and θ is rotational angle; and the acceleration data is then mapped into the continuous drill-string positions using:

$$P(x,y,z,t+dt)=P(x,y,z,t)+\iint a(x,y,z,t)dt^2$$

where P(x, y, z, t) is a position vector in the global stationary coordinate frame referenced at a center of the drill pipe; a(x, y, z, t) is an acceleration vector in the global stationary coordinate frame referenced at the center of the drill pipe; t is travel time of the drill pipe; and dt is time interval the drill pipe moves from P(x, y, z, t) to P(x, y, z, t+dt).

11. The system of claim 10, wherein the program logic further includes detection logic executed by the processor for determining dysfunction associated with equipment failure.

12. The system claim 11, wherein the equipment comprises drilling equipment.

13. The system of claim 11, wherein the detection logic further comprises applying an output to an activity for controlling the dysfunction.

14. The system of claim 10, wherein the mapping logic estimates tangential acceleration from a vector cross product of radial acceleration and axial acceleration.

15. The system of claim 10, wherein the acceleration measurements include at least one of axial vibration, downhole rotations per minute (RPM), down-hole torque, gravitational acceleration, centripetal acceleration, radial acceleration, tangential acceleration, distance from surface, surface RPM, surface torque, hole depth, and rig state.

16. The system of claim 10, wherein the acceleration measurements are obtained from one or more downhole tri-axial accelerometers.

17. The system of claim 10, wherein the mapping comprises a 3D view of the drill string positions.

18. The system of claim 10, wherein the mapping comprises a planar view of the drill string positions.

* * * * *